US006133216A

United States Patent [19]

Löffler et al.

[11] Patent Number: 6,133,216

[45] **Date of Patent: *Oct. 17, 2000**

[54] COATED AMMONIUM NITRILE BLEACH ACTIVATOR GRANULES

[75] Inventors: Matthias Löffler, Niedernhausen; Gerd Reinhardt, Kelkheim, both of Germany

[73] Assignee: Clariant GmbH, Frankfurt, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/152,840

[22] Filed: Sep. 15, 1998

[30] Foreign Application Priority Data

Sep. 16, 1997 [DE] Germany ..... 197 40 671

[51] Int. Cl.[7] ..... C11D 3/395; C11D 13/10; C11D 13/20

[52] U.S. Cl. ..... 510/349; 510/276; 510/286; 510/309; 510/310; 510/312; 510/314; 510/349; 510/353; 510/367; 510/376; 510/452

[58] Field of Search ..... 510/276, 286, 510/309, 310, 312, 349, 353, 367, 376, 314, 452

[56] References Cited

U.S. PATENT DOCUMENTS

| | | | |
|---|---|---|---|
| 3,975,280 | 8/1976 | Hachmann | 252/102 |
| 4,003,841 | 1/1977 | Hachmann et al. | 252/94 |
| 4,064,062 | 12/1977 | Yurko | 252/99 |
| 4,087,369 | 5/1978 | Wevers | 252/102 |
| 4,372,868 | 2/1983 | Saran et al. . | |
| 4,695,397 | 9/1987 | Sommer et al. . | |
| 4,751,015 | 6/1988 | Humphreys et al. . | |
| 4,883,917 | 11/1989 | Smith et al. . | |
| 5,281,361 | 1/1994 | Adams et al. | 252/786.38 |
| 5,458,801 | 10/1995 | Oyashiki et al. | 252/186.25 |
| 5,478,356 | 12/1995 | Kaaret | 8/111 |
| 5,716,569 | 2/1998 | Berenbold et al. | 264/115 |
| 5,747,441 | 5/1998 | Domburg et al. | 510/375 |

FOREIGN PATENT DOCUMENTS

| | | |
|---|---|---|
| 0037026 | 10/1981 | European Pat. Off. . |
| 0075818 | 4/1983 | European Pat. Off. . |
| 0186052 | 7/1986 | European Pat. Off. . |
| 0284292 | 9/1988 | European Pat. Off. . |
| 0303520 | 2/1989 | European Pat. Off. . |
| 0331229 | 9/1989 | European Pat. Off. . |
| 0458396 | 11/1991 | European Pat. Off. . |
| 0464880 | 1/1992 | European Pat. Off. . |
| 0468824 | 1/1992 | European Pat. Off. . |
| 0475511 | 3/1992 | European Pat. Off. . |
| 4232494 | 4/1993 | Germany . |
| 19605526 | 8/1997 | Germany . |
| 1382594 | 2/1975 | United Kingdom . |
| WO 90/01535 | 2/1990 | WIPO . |
| WO 92/13798 | 8/1992 | WIPO . |
| WO 94/03305 | 2/1994 | WIPO . |
| WO 94/26862 | 11/1994 | WIPO . |
| WO 96/40661 | 12/1996 | WIPO . |

OTHER PUBLICATIONS

European Search Report.
Derwent Patent Family Report and/or Abstract.

*Primary Examiner*—Yogendra Gupta
*Assistant Examiner*—Charles Boyer
*Attorney, Agent, or Firm*—Miles B. Dearth; Scott E. Hanf

[57] ABSTRACT

The invention relates to coated bleach activator granules of ammonium nitriles, which have been obtained by coating ammonium nitrile base granules with a water-soluble coating substance. The base granules are preferably thermally conditioned during or after the coating with the coating substance.

23 Claims, No Drawings

COATED AMMONIUM NITRILE BLEACH ACTIVATOR GRANULES

BACKGROUND OF THE INVENTION

Bleach activators are important constituents in detergents, stain removal salts and dishwashing detergents. They permit a bleaching action even at relatively low temperatures by reacting with a source of hydrogen peroxide—in most cases perborates or percarbonates—to release an organic peroxycarboxylic acid or when ammonium nitriles are added as activator, form a peroxyimidic acid as bleaching agent.

Representative examples of bleach activators are, for example, N,N,N'N'-tetraacetylethylenediamine (TAED), glucose pentaacetate (GPA), xylose tetraacetate (TAX), sodium 4-benzoyloxybenzenesulfonate (SBOBS), sodium trimethylhexanoyloxybenzenesulfonate (STHOBS), tetraacetylglucoluril (TAGU), tetraacetylcyanic acid (TACA), di-N-acetyldimethylglyoxine (ADMG) and 1-phenyl-3-acetylhydantoin (PAH). Reference may be made, for example, to GB-A-836 988, GB-A-907 356, EP-A-0 098 129 and EP-A-0 120 591.

Cationic bleach activators which contain a quaternary ammonium group have gained importance over time since they are highly effective bleach activators. Such cationic bleach activators are described, for example, in GB-A-1 382 594, U.S. Pat. No. 4,751,015, EP-A-0 284 292 and EP-A-0 331 229.

In this connection, ammonium nitriles of the formula

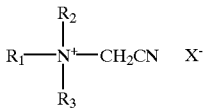

constitute a particular class of cationic bleach activators. Compounds of this type and their use as bleach activators in bleaches are described in EP-A-303 520, EP-A-464 880, EP-A-458 396 and U.S. Pat. No. 4,883,917. In all of the compounds described therein, the nitrogen atom of the ammonium group is substituted by alkyl, alkenyl or aryl groups. A further class of ammonium nitrites is described in German Patent Application 19605526.

The high reactivity and sensitivity to hydrolysis of the bleach activators, particularly in the presence of alkaline detergent constituents, does, however, require said ammonium nitriles to be granulated in order to ensure an adequate shelf life and in order to release the bleaching effect only in the wash.

Numerous auxiliaries and processes have been proposed in the past for granulating these substances. EP-A-0 037 026 describes a process for producing readily soluble activator granules comprising 90 to 98% activator with 10 to 2% cellulose ethers, starch or starch ethers. Granules consisting of bleach activator, film-forming polymers and added organic $C_3$–$C_6$-carboxylic, hydroxycarboxylic or ether carboxylic acid are specified in WO 90/01535. EP-A-0 468 824 discloses granules comprising bleach activator and a film-forming polymer which is more soluble at a pH of 10 than at a pH of 7. DE-A-44 39 039 describes a process for producing activator granules by mixing a dry bleach activator with a dry, inorganic binder material containing water of hydration, compressing this mixture to form relatively large agglomerates, and comminuting these agglomerates to the desired grain size. A waterless production process, by compacting the bleach activator with at least one water-swellable auxiliary, without the use of water, is known from EP-A-0 075 818.

Disadvantages of these activator granules are that the properties of the granules are fixed essentially by the binder and by the granulating method used and that the resulting granules, besides the advantages described in the literature, often have certain disadvantages as well, for example sub-optimal release of active substance, low abrasion resistance, high dust content, inadequate shelf life, separation within the powder or damage to the color of the fabric when used in detergents and cleaning compositions.

In order to give granules defined properties a coating step is often carried out subsequent to the granulating step. Common methods are coating in mixers (mechanically induced fluidized bed) or coating in fluidized-bed apparatus (pneumatically induced fluidized bed).

For instance, WO 92/13798 describes, for a bleach activator, coating with a water-soluble organic acid which melts at above 30° C., and WO 94/03305 describes coating with a water-soluble acidic polymer in order to reduce color damage to the laundry.

WO 94/26862 discloses the coating of granules consisting of bleach activator and water- and/or alkali-soluble polymer with an organic compound melting at between 30° C. and 100° C. for reducing separation in the pulverulent end product. In this case the activator granules are placed in a L ödige plowshare mixer, circulated at from 160 to 180 rpm at room temperature, without using the pelletizer, and then sprayed with the hot melt. A disadvantage of this process is the very poor coating quality, which, although it brings about a reduction in separation in the pulverulent end product, has no effect on the other granule properties, such as release of active substance, abrasion resistance, dust content or shelf life, for example. The positive effect on the separation behavior can probably be attributed to a droplet-like solidification of the coating substance on the granule surface allowing the individual grains to hook together in the bulk product.

The object of the present invention was to develop a coating process for activator granules containing ammonium nitrile as activator which makes it possible to tailor the granule properties within a wide range at the same time as making optimum use of the coating material.

This object was achieved by coating with a water-soluble substance. The granules coated in this way can be thermally conditioned during or after coating.

SUMMARY OF THE INVENTION

The invention thus provides coated granules of an ammonium nitrile and a process for the preparation of coated granules of an ammonium nitrile which comprises coating base granules of an ammonium nitrile with a water-soluble coating substance. These coated granules can be thermally conditioned during coating or subsequently thereto.

DESCRIPTION OF THE PREFERRED EMBODIMENTS

The base granules which can be used are all ammonium nitriles which in granulated form have a melting point above 60° C. Particularly suitable granules in this connection are the ammonium nitrites described in the aforementioned literature.

Particular preference is given to ammonium nitriles of the formula

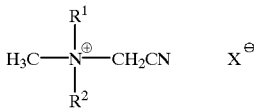

in which $R^1$ and $R^2$ of $C_1$–$C_4$-alkyl, and X is an anion, for example chloride or methosulfate.

The base granules can comprise one or more of these ammonium nitriles or in addition also bleach activators of another structure, for example N,N,N',N'-tetraacetylethylenediamine (TAED), glucose pentaacetate (GPA), xylose tetraacetate (TAX), sodium 4-benzoyloxybenzenesulfonate (SBOBS), sodium trimethylhexanoyloxybenzenesulfonate (STHOBS), tetraacetylglucoluril (TAGU), tetraacetylcyanic acid (TACA), di-N-acetyldimethylglyoxine (ADMG) and 1-phenyl-3-acetylhydantoin (PAH).

These base granules can include the customary granulating auxiliaries, which should have a melting point above 60° C., preferably above 100° C. Suitable such auxiliaries are film-forming polymers, for example cellulose ethers, starch, starch ethers, homopolymers, copolymers and graft copolymers of unsaturated carboxylic acids and/or sulfonic acids and also the salts thereof; organic substances, for example cellulose, crosslinked polyvinylpyrrolidone, or inorganic substances, for example silicic acid, amorphous silicates, zeolites, bentonites, alkali metal phyllosilicates of the formula $MM'Si_xO_{2x-1}*y\ H_2O$(M, M'=Na, K, H; x=1.9–23; y=0–25), orthophosphates, pyrophosphates and polyphosphates, phosphonic acids and their salts, sulfates, carbonates and bicarbonates. Depending on what is required these granulating auxiliaries can be employed as individual substances or as mixtures.

In addition to the bleach activator and the granulating auxiliary the bleach activator base granules may also include further additives which enhance properties such as, for example, shelf life and bleach activation. Such additives include inorganic acids, organic acids, for instance mono- or polybasic carboxylic acids, hydroxycarboxylic acids and/or ether carboxylic acids, and also salts thereof, complexing agents, metal complexes and ketones. Depending on what is required, the abovementioned additives can be employed as individual substances or as mixtures.

These base granules are prepared by mixing the dry bleach activator with the dry granulating auxiliary, compressing this mixture to give relatively large agglomerates and comminuting these agglomerates to the desired particle size.

The weight ratio of bleach activators to granulating auxiliary is usually from 50:50 to 98:2, preferably from 70:30 to 96:4. The amount of additive is particularly dependent on its type. For example acidifying additives and organic catalysts for increasing the performance of the peracid are added in amounts of 0–20% by weight, in particular in amounts of 1–10% by weight, based on the total weight, whereas metal complexes are added in concentrations in the ppm range.

Suitable coating substances are all compounds or mixtures thereof which are solid at room temperature and which soften or melt in the range from 30 to 100° C. Examples of such are:

$C_8$–$C_{31}$ fatty acids (e.g. lauric, myristic, stearic acid); $C_8$–$C_{31}$ fatty alcohols; polyalkenyl glycols (e.g. polyethylene glycols having a molar mass of from 1000 to 50,000 g/mol); nonionics (e.g. $C_8$–$C_{31}$ fatty alcohol polyalkoxylates with from 1 to 100 moles of EO); anionics (e.g. alkanesulfonates, alkylbenzenesulfonates, α-olefinsulfonates, alkylsulfates, alkyl ether sulfates having $C_8$–$C_{31}$ hydrocarbon radicals); polymers (e.g. polyvinyl alcohols); waxes (e.g. montan waxes, paraffin waxes, ester waxes, polyolefin waxes); silicones.

Within the coating substance which softens or melts in the range from 30 to 100° C. there may additionally be other substances, not softening or melting in this temperature range, in dissolved or suspended form, examples being polymers (e.g. homopolymers, copolymers or graft copolymers of unsaturated carboxylic acids and/or sulfonic acids and alkali metal salts thereof, cellulose ethers, starch, starch ethers, polyvinylpyrrolidone); organic substances (e.g. mono- or polybasic carboxylic acids, hydroxycarboxylic acids or ether carboxylic acids having 3 to 8 C atoms, and the salts thereof); colorants; inorganic substances (e.g. silicates, carbonates, bicarbonates, sulfates, phosphates, phosphonates).

Depending on the desired properties of the coated activator granules, the content of coating substance can be from 1 to 30% by weight, preferably from 5 to 15% by weight, based on coated activator granules.

The coating substances can be applied using mixers (mechanically induced fluidized bed) and fluidized-bed apparatus (pneumatically induced fluidized bed). Examples of possible mixers are plowshare mixers (continuous and batchwise), annular bed mixers or else Schugi mixers. If a mixer is used, the thermal conditioning can take place in a granule preheater and/or directly in the mixer and/or in a fluidized bed downstream of the mixer. The coated granules can be cooled using granule coolers or fluidized-bed coolers. In the case of fluidized-bed apparatus, the thermal conditioning takes place by way of the hot gas used for fluidizing. The granules coated by the fluidized-bed method, as with the mixer method, can be cooled by way of a granule cooler or a fluidized-bed cooler. In both the mixer method and the fluidized-bed method the coating substance can be sprayed on by way of a single-substance or dual-substance nozzle apparatus.

The optional thermal conditioning comprises a heat treatment at a temperature from 30 to 100° C. but no higher than the melting or softening temperature of the respective coating substance. It is preferred to operate at a temperature which lies just below the melting or softening temperature.

The grain size of the coated bleach activator granules is from 0.1 to 2.0 mm, preferably from 0.2 to 1.0 mm and, with particular preference, from 0.3 to 0.8 mm.

The precise temperature during thermal conditioning or the difference in temperature from the melting point of the coating substance is dependent on the coating rate, on the thermal conditioning time and on the properties desired for the coated bleach activator granules, and must be determined in preliminary experiments for the particular system.

The period for thermal conditioning is from approximately 1 to 180, preferably from 3 to 60 and, with particular preference, from 5 to 30 minutes.

The advantage of this thermal conditioning is that the liquid coating material does not solidify too rapidly and thus has the possibility of running as a thin film over the surface of the granules. This produces a highly uniform coating of the grain in a thin layer with the coating substance, and an optimum coating effect for use of a minimum amount of coating substance. In conventional processes, i.e. those without a thermal conditioning step, solidification of the individual droplets on the cold granule surface is too rapid.

Consequently, the surface is covered only with fine individual droplets and still has large coating voids. As a result, the desired coating effect is not fully obtained or a much higher amount of coating substance is required in order to obtain the desired coating effect. In the latter case, however, the content of activator substance is reduced, which in many cases is undesirable.

By means of the novel process it is possible to tailor the properties of the ammonium nitrile granules within broad ranges to the desired specifications by an appropriate choice of the coating substance, the coating rate and the process temperature regime. In this context it is possible in particular to optimize in a targeted manner the following activator granule properties.

1. Time-optimized release of active substance

In order to avoid interaction between the bleaching system and the enzyme system it is advantageous to couple a slightly delayed reaction and active-substance release of the bleaching system with rapid enzyme action. In this way the enzymes can develop their washing power fully within the first few minutes of the washing process without being damaged by the bleaching system. Only after the enzymes have done their job is the bleaching process set in motion by reaction of the bleach activator with the hydrogen peroxide source. Appropriate coating of the bleach activator makes it possible to tailor the reactivity, i.e. the rate of dissolution or the rate of formation of the peracid, specifically to the enzyme system. The process permits controlled adjustment of the rate of formation of the peracid at the same time as having a minimal amount of coating substance and thus the maximum activator content.

2. Increasing the abrasion resistance

By coating granules with softening or melting substances it is possible to increase the abrasion resistance of activator granules. The increase in abrasion resistance is greater the better the coating of the granule surface with the coating substance. The novel coating process makes it possible, with a minimum coating rate, to bring about optimum flow of the coating substance over the granule surface and thus an optimum enhancement of the abrasion resistance.

3. Extending the shelf life

When a detergent and cleaning composition is stored there may be a reaction at the boundary between the activator grain and a directly adjacent grain of the hydrogen peroxide source, with subsequent loss of active oxygen and thus uncontrolled breakdown of the bleaching system. By means of optimum coating, as is possible only through the novel coating process, a complete protective layer is constructed at the grain size, which layer then prevents reaction of the activator grain with the grain of the hydrogen peroxide source in the course of storage. When water-soluble and/or low-melting coating substances are used it is nevertheless possible to obtain the required bleaching performance in the washing process.

The granules obtained in this way are directly suitable for use in detergents and cleaning compositions. They are ideal for use in heavy-duty detergents, stain removal salts, dishwashing detergents, all-purpose cleaning powders and denture cleaners. In such formulations the granules of the invention are in most cases employed in combination with a hydrogen peroxide source. Examples thereof are perborate monohydrate, perborate tetrahydrate, percarbonates, and adducts of hydrogen peroxide with urea or with amine oxides. The formulation may also feature further, prior art detergent constituents, such as organic or inorganic builders and cobuilders, surfactants, enzymes, washing additives, optical brighteners and fragrance.

EXAMPLES

Example 1

Preparation 10 kg of a mixture of 92% by weight of ammonium nitrile (trimethylammonium acetonitrile toluenesulfonate) and 8% by weight of bentonite (Laundrosil DGA) are intensively mixed in a 50 l Lödige mixer at a speed of 70 rpm over a period of 10 min. This homogeneous mixture is then compressed to flakes on a Pharmapaktor roller compactor (Bepex (DE)) at a pressing force of from 50 to 60 kN; the flakes are then comminuted in a two-stage grinding process, pregrinding with toothed-disk rollers (Alexanderwerk (DE)) and comminution in a sieve (Fewitt (DE)) at a mesh size of 2000 $\mu$m.

This gives 5.3 kg of granules, referred to as G1, having a particle size distribution of from 200 to 1600 $\mu$m. (Yield: 53%), and also 2.8 kg of a fine material <200 $\mu$m (28%), which can be recycled by recompacting, and 1.9 kg of coarse material >1600 $\mu$m (19%), which can be processed by regrinding.

Example 2

Coating by the Fluidized-Bed Method with Downstream Thermal Conditioning

500–600 g of granules (G1) were placed in a fluidized bed (fluidized-bed apparatus Strea 1 from Aeromatic) and sprayed with a hot (about 80° C.) melt of stearic acid. For comparison purposes, in one case the fluidized bed was operated at low temperatures and after the end of spraying was cooled again for about 5 minutes. In the other case, in accordance with the preferred process, the coated granules were placed back in the fluidized bed and subjected to thermal conditioning. To this end the fluidized bed was heated gradually to temperatures of about 65 to 70° C. and this product temperature was held constant for about 5 to 8 minutes. The thermally conditioned product was then cooled down again in stages.

The coating quality of the products was assessed by determining the rate of formation of peracetic acid at a temperature of 20° C. The slower the formation of peracetic acid the better the degree of coating achieved.

In order to determine the rate of formation of peracetic acid, 1 l of distilled water, 8.0 g of test detergent WMP and 1.5 g of sodium perborate monohydrate were placed in a 2 l glass beaker at 20° C. and the mixture was stirred at from 250 to 280 rpm using a magnetic stirrer. Then, after 1 to 2 minutes, 0.5 g of the coated granules was added. After one minute an aliquot of 50 ml was removed by pipette and introduced onto 150 g of ice and 5 ml of 20% strength acetic acid in an Erlenmeyer flask. Immediately following the addition of 2 to 3 ml of 10% strength potassium iodide solution, the sample was titrated to the potentiometric endpoint with 0.01 molar sodium thiosulfate solution (Titroprocessor 716 DMS from Metrohm) and the amount of peracetic acid was calculated from the amount of sodium thiosulfate consumed. Then further samples were taken at intervals of 2 to 5 minutes and were titrated as described. The entire procedure was repeated until equal or descending amounts of peracetic acid were found after three successive titrations. The maximum amount of peracetic acid found was then taken as being 100% and on this basis, finally, the amount of peracetic acid formed after 5, 10 and 20 minutes was determined in percent as a measure of the rate of formation of peracetic acid.

TABLE 1

Rate of formation of peracid by uncoated granules I and granules I coated in the fluidized-bed method, with or without subsequent thermal conditioning:

| Peracetic acid formed [%] | 5 min | 10 min | 20 min |
|---|---|---|---|
| G1 (uncoated) | 70 | 92 | 100 |
| G1 + 10% Stearic acid, thermally conditioned | 11 | 24 | 50 |
| G1 + 20% stearic acid, thermally conditioned | 14 | 25 | 54 |
| G1 + 10% stearic acid, not thermally conditioned | 72 | 87 | 97 |
| G1 + 20% stearic acid, not thermally conditioned | 42 | 63 | 82 |

Coating greatly delays the release of peracid. By means of the thermal conditioning, it is possible to bring about a marked improvement in the coating quality, expressed by the delay in the formation of per acid, for the same coating rate (compare products 2 and 4 and products 3 and 5). To achieve an optimum coating quality, an amount of 10% coating substance (product 2) is sufficient given appropriate thermal conditioning.

Example 3

Shelf Life of Ammonium Nitrile Granules in Detergent Formulations

The shelf life was tested in ready made-up folding boxes (height: 6.5 cm; width 3.2 cm; depth 2.2 cm) at 38°C. and 80% relative atmospheric humidity (rH) over a period of 28 days. Each folding box was filled with a homogeneous mixture of 8.0 g of test detergent WMP, 1.5 g of sodium percarbonate and 0.5 g of the ammonium nitrile granules to be tested and then was sealed at the top with Tesafilm. All samples were mixed and dispensed into the boxes on the same day. The filled folding boxes were then placed at a sufficient distance from one another in the climatically controlled cabinet and stored at 38° C./80% rH. After storage periods of 0, 3, 6, 9, 15, 23 and 28 days the samples were removed from the cabinet, the entire sample was introduced at 20° C. into 1 l of distilled water, while stirring with a magnetic stirrer (250 to 280 rpm), and 1 g of sodium percarbonate was added. Subsequent determination of the amount of peracid formed was as indicated in Example 2. The ammonium nitrile content of the sample was then calculated from the maximum value of peracid found. The ammonium nitrile durability represents the percentage ammonium nitrile content of the sample after storage relative to the ammonium nitrile content of the unstored sample.

TABLE 2

Shelf life in detergent formulations of ammonium nitrile granules coated by the fluidized-bed method

| Ammonium nitrile granules (G1) | Ammmonium nitrile durability after storage | | | | | | |
|---|---|---|---|---|---|---|---|
| | 0d | 3d | 6d | 9d | 15d | 23d | 28d |
| G1 | 100 | 29 | 15 | 12 | 10 | 7 | 6 |
| G1 + 10% stearic-acid, thermally conditioned | 100 | 88 | 69 | 62 | 57 | 55 | 55 |
| G1 + 10% stearic acid, not thermally conditioned | 100 | 69 | 35 | 30 | 28 | 26 | 23 |

Example 4

The shelf life of the coated granules was additionally tested under conditions simulating those met in practice in an Öko-Lavamat 6753 multi-component washing machine (AEG, Nuremberg) on bleach test fabrics in the presence of pure test laundry. In accordance with the metering instructions for water hardness region 3, 70 g of reference detergent (WMP) are introduced into the detergent compartments of the washing machine. The bleach component introduced into the detergent compartment was 8.0 g of percarbonate and also a) 3.18 g of granules G1+10% stearic acid (82%), coated, thermally conditioned b) 3.18 g of granules G1+10% stearic acid (82%), coated, not thermally conditioned c) 2.93 g of granules G1 (92%), uncoated For comparison purposes, ammonium nitrile trimethylammonium acetonitrile toluenesulfonate (2.7 g) in powder form was tested (Ex. 4d)

The ballast material used is 2 kg of terry fabric, and the test soiling 10 bleachable soilings (tea, red wine, curry, grass from Krefeld Laundry Research). The laundry was washed in a main wash at 40° C. Evaluation takes place by determining the degree of whiteness after washing by addition of the reflectance differences.

TABLE 3

Reflectance differences of the bleach components a)–d)

| Ex. 4a) | Ex. 4b) | Ex. 4c) | Ex. 4d) |
|---|---|---|---|
| 352 | 304 | 275 | 50 |

T = 40° C., tea, red wine, curry, grass

What is claimed is:

1. A bleach activator for detergent compositions in which the activator exhibits improved properties of activator release, abrasion resistance, and shelf life, said bleach activator comprising:

a granulated compressed dry admixture of an ammonium nitrile composition of the formula

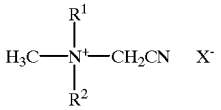

in which $R^1$ and $R^2$ are $C_1$–$C_4$-alkyl and X is an anion and an auxiliary granulating composition; and a substantially uniform, thin, thermally conditioned coating on the surfaces of the respective individual granules of said compressed dry admixture of a substance that moderates the physical contact between the granules and other substances in a detergent composition;

said granulated dry admixture has a melting point above 100° C.

said auxiliary granulating composition has a melting point sufficiently higher than the melting point of said coating substance which has a melting point of from 30° C. to 100° C., thereby preventing the said granulated dry admixture composition from melting and the granules from disintegrating when the coating substance is applied as a melt or heated to its melting temperature.

2. The bleach activator according to claim 1 wherein the granulated admixture additionally comprises one or more bleach activators which are not ammonium nitrile.

3. The bleach activator according to claim 1 wherein the coating substance comprises at least one material selected from the group consisting of fatty acids, fatty alcohols, polyalkylene glycols, nonionic surfactants, anionic surfactants, polymers, waxes and silicones and combinations thereof.

4. The bleach activator according to claim 1 wherein the coating substance comprises at least one material selected from the group consisting of polymers, organic substances and inorganic substances in dissolved or suspended form and combinations thereof.

5. The bleach activator according to claim 1 wherein the content of the coating substance is between about 1 and about 30% by weight based on the weight of the bleach activator granules.

6. The bleach activator according to claim 1 wherein the coating substance is applied in a mixer or in a fluidized-bed apparatus.

7. The bleach activator according to claim 1 wherein the particle size of the granulated admixture granules is between about 0.1 and 2.0 mm.

8. The bleach activator according to claim 1 wherein the granulated admixture granules contain up to 20% by weight, based on the weight of the granulated admixture granules, of one or more additives selected from the group consisting of inorganic acids, organic acids, complexing agents, ketones and metal complexes and any combinations thereof.

9. A detergent, a cleaning composition, bleach or disinfectant comprising the bleach activator granules according to claim 1.

10. A method of producing bleach activator granules for detergent compositions in which the granules exhibit improved properties of activator release, abrasion resistance, and shelf life, the method comprising:

forming ammonium nitrile base granules by mixing an ammonium nitrile with a granulation auxiliary, compressing this mixture to give relatively large agglomerates and comminuting these agglomerates to the desired particle size and;

thereafter under mixing, coating the ammonium nitrile base granules with a coating substance that moderates the physical contact between the granules and other substances in a detergent composition, and thermally conditioning the coating at a temperature of from 30° C. to 100° C. but not higher than the melting or softening temperature of said coating substance.

11. The method of producing bleach activator granules as claimed in claim 10, wherein the granules comprise an ammonium nitrile of the formula

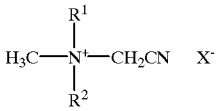

in which $R^1$ and $R^2$ are $C_1$–$C_4$-alkyl and X is an anion.

12. The method of producing bleach activator granules as claimed in claim 10, wherein the ammonium nitrile base granules have a melting point above 100° C.

13. The method of producing bleach activator granules as claimed in claim 10, wherein the coating substance has a softening or melting point in the range from 30 to 100° C.

14. The method of producing bleach activator granules as claimed in claim 10 wherein the heating of the coating takes place during or after the coating step at temperatures in the vicinity of the softening or melting point of the coating substance.

15. The method of producing bleach activator granules as claimed in claim 10 wherein the ammonium nitrile base granules additionally comprise one or more bleach activators which are not ammonium nitrile.

16. The method of producing bleach activator granules as claimed in claim 10 wherein the coating substance comprises at least one material selected from the group consisting of fatty acids, fatty alcohols, polyalkylene glycols, nonionic surfactants, anionic surfactants, polymers, waxes and silicones and combinations thereof.

17. The method of producing bleach activator granules as claimed in claim 10, wherein the coating substance comprises at least one material selected from the group consisting of polymers, organic substances and inorganic substances in dissolved or suspended form and combinations thereof.

18. The method of producing bleach activator granules as claimed in claim 10 wherein the content of the coating substance is between about 1 and 30% by weight based on the coated bleach activator granules.

19. The method of producing bleach activator granules as claimed in claim 10 wherein the coating substance is applied in a mixer or in a fluidized-bed apparatus.

20. The method of producing bleach activator granules as claimed in claim 10 wherein the particle size of the bleach activator granules is from 0.1 to 2.0 mm.

21. The method of producing bleach activator granules as claimed in claim 10 wherein the base granules contain up to 20% by weight, based on the weight of the base granules, of one or more additives selected from the group consisting of inorganic acids, organic acids, complexing agents, ketones and metal complexes and combinations thereof.

22. The method of producing bleach activator granules as claimed in claim 10 wherein the particle size of the bleach activator granules is from 0.2 to 1.0 mm.

23. The method of producing bleach activator granules as claimed in claim 10 wherein the particle size of the bleach activator granules is from 0.3 to 0.8 mm.

* * * * *